US005569372A

United States Patent [19]

Smith

[11] Patent Number: 5,569,372

[45] Date of Patent: Oct. 29, 1996

[54] CATCH BASIN STRUCTURE FOR INTERCEPTION OF CONTAMINANTS HAVING DETACHABLE PARTS

[75] Inventor: Robert G. Smith, Brampton, Canada

[73] Assignee: Her Majesty the Queen in right of Canada as represented by the Minister of Transport Canada, Ottawa, Canada

[21] Appl. No.: 461,553

[22] Filed: Jun. 5, 1995

[30] Foreign Application Priority Data

Jul. 13, 1994 [CA] Canada ..... 2127974

[51] Int. Cl.[6] ..... B01D 17/12; E03F 5/06; E03F 5/14

[52] U.S. Cl. ..... 210/85; 52/20; 210/96.1; 210/164; 404/25

[58] Field of Search ..... 210/85, 96.1, 163, 210/164, 170; 404/4, 25, 26; 405/37, 40, 52; 52/19, 20, 21

[56] References Cited

U.S. PATENT DOCUMENTS

| | | | |
|---|---|---|---|
| 2,246,390 | 6/1941 | Smith | 210/164 |
| 4,136,010 | 1/1979 | Pilie et al. | 210/164 |
| 4,650,365 | 3/1987 | Runnels | 404/4 |
| 5,383,745 | 1/1995 | Shannon | 404/4 |

*Primary Examiner*—Joseph W. Drodge
*Attorney, Agent, or Firm*—Juliusz Szereszewski

[57] ABSTRACT

In order to prevent hazardous substances—oils, fuels, deicing liquids—spilled onto the ground or pavement, e.g. at an airport, to enter storm sewer system with subsequent contamination of the environment, a catchbasin structure is provided comprising a receptacle with an opening closable with a valve in a manner to seal off the entry of the liquid into the storm sewer system. Instead, the liquid can be kept in the receptacle and on the ground in the area adjacent to the catchbasin, or selectively directed to a storage tank system for treatment or recovery.

7 Claims, 1 Drawing Sheet

CATCH BASIN STRUCTURE FOR INTERCEPTION OF CONTAMINANTS HAVING DETACHABLE PARTS

FIELD OF THE INVENTION

This invention relates to a catch basin structure which enables at least partial interception of contaminants which may be present in surface drainage to prevent such contaminants, alone or with stormwater, from entering a storm sewer system and subsequently polluting the environment.

BACKGROUND OF THE INVENTION

Airports in northern climates are obliged to employ deicing procedures on aircraft when either hoarfrost or freezing precipitation is encountered. The use of deicing fluid (traditionally propylene glycol or ethylene glycol) results in residue on the ground which, if allowed to enter a stormsewer system, would contaminate the natural environment. Other environmentally unacceptable liquids encountered at airports are fuels, hydraulic fluids, lavatory truck spills, oils and snow melting chemicals such as urea. The discharge of such substances into receiving streams and lakes has been ruled environmentally unacceptable. Accordingly, such substances should be prevented from entering the storm sewer systems which can happen most commonly at storm water catch basins. Such catch basins located at airports, or vehicle service stations, should be equipped with implements, or structures, for intercepting harmful contaminants with subsequent removal or discharge into holding or treatment facilities, while permitting uncontaminated rain water to drain into the sewer system.

U.S. Pat. No. 4,136,010 to Pilié et al. describes an exemplary catchbasin structure having a peripheral trough connected through a valve to a receiver system. The structure enables a selective interception and recovery of contaminants entering the catchbasin. The structure fulfils its function satisfactorily except during heavy rainfalls where the runoff, sometimes carrying pollutants such as deicing fluid, cannot be accommodated by the capacity of the trough and the associated conduits, the result being an overflow of contaminated water into the storm sewer system.

Canadian Patent No. 38,412 issued in 1892 describes a concrete gully for installation in a catchbasin, the gully having a hinged trap for allowing the flow of liquids into the catchbasin but preventing or reducing the emission of sewer gas therefrom.

Various catchbasin constructions are also described in U.S. Pat. No. 5,032,264 to Geiger, U.S. Pat. No. 2,993,600 to Ressler and in Canadian Patent No. 307,563 to Egan.

SUMMARY OF THE INVENTION

It is an object of the invention to provide a catchbasin structure designed to substantially prevent the flow of liquid contaminants into the storm sewer system via the catchbasin from the ground level adjacent the catchbasin.

It is another object of the invention to provide a catchbasin structure enabling, selectively, a discharge of unpolluted rainwater into the storm sewer system or a retention of contaminants flowing into the structure from the ground level adjacent the catchbasin.

It is still another object of the invention to provide a system for automatic operation of the structure of the invention in accordance with the above objects.

According to the invention, there. is provided, in one embodiment, a catchbasin structure for placement in a catchbasin cavity disposed below ground level and connected to a storm sewer system, the structure comprising a receptacle mounted around the upper periphery of the catchbasin cavity in a manner to receive all the liquid flowing by gravity from the adjacent ground surface and extending downwardly from said upper periphery, a perforated cover placed over said receptacle, said receptacle having in its lowermost portion an outlet and a valve associated with said outlet and adapted to selectively open or close said outlet, and valve control means operable to selectively open or close said valve. When the valve is closed, the flow of a liquid from ground level through said receptacle into the cavity and the sewer system is positively prevented.

Alternatively, the receptacle may have in its lowermost portion two outlets, each associated with a valve adapted to open or close the respective outlet, wherein a first of the outlets is connected to a liquid retention system and the second outlet is in communication with the cavity and the sewer system.

The receptacle of the structure may comprise two or more parts which are interconnected in a detachable manner while still providing a sealed container for any liquid residing in the receptacle when the valve or valves are closed. This allows a part of the receptacle to be disassembled from the rest and removed from the structure thereby allowing an access to the catchbasin for maintenance and repairs.

The structure may also comprise sensing means installed in a manner to detect and signal the presence of contaminants within the receptacle. Control means for selectively closing the valve or valves on response to a signal from the sensing means may be provided. Alternatively, the valves may be operated manually according to the conditions at the catchbasin.

It is a feature of the invention to provide a structure adapted to completely seal off, by closing its valve or valves, the catchbasin cavity from the ingress of liquid from the ground level around the catchbasin. While this may create a temporary "flooding" of an area surrounding the catchbasin, e.g. during a heavy rainfall and simultaneous spill of a contaminating liquid, the advantage, particularly in comparison with U.S. Pat. No. 4,136,010, is an effective prevention of contamination of the environment by the spilled substances and a possibility of retention of the contaminants for treatment or recovery.

The invention is believed to be particularly useful at airports where the accumulation of sprayed deicing liquids, or spills of fuel or hydraulic fluids can happen and where it can be installed in catchbasins at specific areas of the apron.

BRIEF DESCRIPTION OF THE DRAWINGS

The invention will now be described in more detail in conjunction with the accompanying drawings in which.

DETAILED DESCRIPTION OF THE INVENTION

Figure 1:
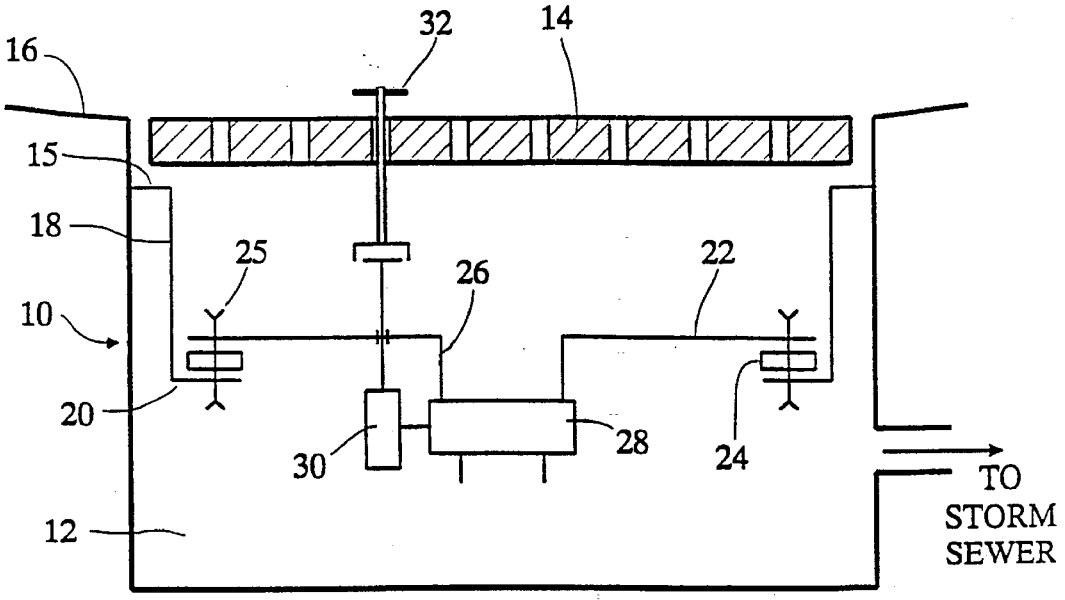
FIG. 1 is a diagrammatic cross-sectional view of a catchbasin with an exemplary structure of the invention.
Figure 2:
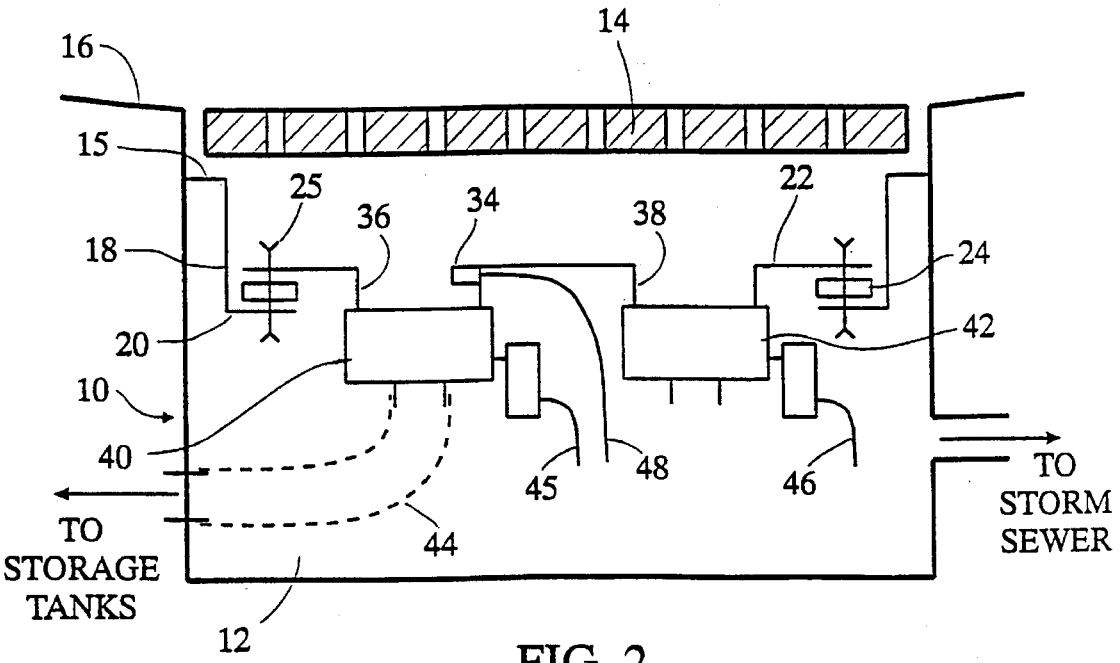
FIG. 2 is a diagrammatic cross-sectional view of a catchbasin with another embodiment of the structure.

As shown in FIGS. 1 and 2, a typical catchbasin 10 features a cavity 12 which is usually covered with a grate 14 detachably disposed on a peripheral ledge 15. The ground adjacent to the catchbasin, in this case a section of airport apron 16, is usually sloped to facilitate the drainage. Liquid entering the cavity will flow into the storm sewer system, not shown, through an opening indicated for that purpose.

FIG. 1 illustrates a simple embodiment of the structure of the invention. The structure has a frame 18 which is mounted on its periphery to the ledge 15 in a manner preventing leaks between the ledge and the frame 18. This can be accomplished simply by welding or other known means.

As seen in FIG. 1, the frame 18 extends downwardly from the ledge 15 and ends with a peripheral lip 20. A bottom plate 22 is mounted to the frame 18 through a gasket 24 by means of screws 25 or other removable connecting means. The plate 22 has an opening 26 with a tubular section to which is attached a butterfly valve 28 with an actuator 30. The valve is manually operable using an operating key 32. An operating shaft of the valve actuator 30 protrudes through a watertight seal in the plate 22.

The frame 18 and the plate 22 in both the embodiments illustrated herein form a receptacle which may be fully closed at the bottom by the closure of the valve or valves.

In the embodiment of FIG. 1, with manually operated valve, there is little need for a sensor to detect the presence of a contaminant, e.g. PEG, as this embodiment is particularly suited to a situation such as aircraft deicing where the appearance of a contaminated liquid at the catchbasin is predictable and the valve can be closed manually before deicing commences. Furthermore, the valve can be kept closed until virtually all contaminated liquid has been cleaned off the apron surface and the receptacle. However, such a sensor may be installed, for instance at the opening 26, to guard against an accidental spill entering the catch basin. A signal generated by the sensor, as described below, could be sent to a remote location to alert the operator.

In a second embodiment, illustrated in FIG. 2, where like elements are designated with same numerals as in FIG. 1, the plate 22 has two openings 36, 38 with corresponding valves 40, 42 installed on the respective tubular sections. The opening 36 is in communication with a storage tank system via a flexible tube 44, shown in broken lines. The other opening 38 enables storm water to enter the cavity 12 when the valve 42 is open and to overflow to the storm sewer system through a separate opening indicated.

A gravity piping system, pump assisted or central vacuum system may be connected to the flexible tubing 44 and the storage tanks to facilitate the retrieval of large amounts of contaminants.

The frame 18 and the plate 22 as well as the valves 28, 40 and 42 are made of known materials, typically corrosion-resistant metals.

In the embodiment of FIG. 2, the valves 40, 42 are remotely operated as indicated by the respective electrical lines 45, 46 which connect the valves to a control unit, not shown. A sensor 34, adapted to detect the presence of PEG or other contaminants, is mounted at the opening 36 of the plate 22 and is also connected to the control unit and it can produce an acoustic signal or an optical signal at the catchbasin, and an additional signal at the control unit via an electric line 48. The control unit may be arranged to automatically operate the valves 40, 42 in response to the signal from the sensor 34.

The positioning of the sensor 34 is a matter of engineering choice. Many types of sensors are available on the market, and they can be installed at various locations depending on their type of operation. It may not be possible, in the embodiments illustrated herein, to avoid entirely the ingress of the initial flow of the contaminant into the catchbasin, but a substantial reduction of the hazard can be achieved.

In operation of the embodiment of FIG. 2, under normal circumstances, when no contaminants are present in or entering the receptacle, the valve 40 is normally closed and the valve 42 is normally open to allow for the run-off from the apron surface, or pavement, to flow directly through the valve 42 into the storm sewer system.

Should an accident occur whereby a contaminating fluid such as aircraft jet fuel, hydraulic fluid, lavatory truck spill or other contaminant be accidentally discharged onto the apron surface 16 and flow by gravity to the receptacle, the sensor 34 will detect its presence and immediately generate a signal to the control unit which in turn will automatically close the valve 42 and open the valve 40 to the storage tanks or to the central vacuum system. The control unit can also serve other functions:

start up the central vacuum system cause an alarm to sound at a manned facility so that an appropriate agency can be contacted to investigate the spill and arrange a cleanup if necessary, and illuminate an indicating light on a display panel to show the location of the catchbasin from which the signal originated.

In both embodiments, a manual or automatic routine may be arranged whereby all the valves (valve 28 in the embodiment of FIG. 1) are closed upon the detection of an emergency e.g. a large spill or a spill combined with a heavy rainfall. This will cause, as discussed above, a flooding of the area adjacent to the catchbasin until mobile trucks or other preventive measures are arranged for to remove the hazardous medium from the receptacle and the vicinity of the catchbasin.

While the embodiment of FIG. 2 employs two valves, the objects of the invention can be met by using a single three-way valve having a single inlet and two outlets, one to the storm sewer system and one to the storage tanks or a central vacuum system. An actuator for such valve would function to open and close the respective routes according to above-described requirements.

The manually operated version illustrated in FIG. 1 is not arranged for an automatic closure of the valve to intercept contaminants, but can be operated to provide a satisfactory closure and 100% seal of the catchbasin against the entry of deicing fluids during winter deicing operations.

The detachable connection between the frame 18 and the plate 22 plus the provision of a flexible tubing 44 allows for disassembling of the plate 22 with the valve 28 or valves 40, 42 and optionally the tubing 44 for the purpose of gaining access to the valves, actuators, and the cavity 12 for inspection and maintenance.

The embodiments of the invention in which an exclusive property or privilege is claimed are defined as follows:

1. A catchbasin structure constructed and arranged for replacement in a catchbasin cavity which is disposed below ground level and connected to a storm sewer system, the structure comprising:

a receptacle mounted sealingly around the upper periphery of the catchbasin cavity and extending downwardly from said upper periphery, a perforated cover placed over said receptacle with said receptacle having in its lowermost portion an outlet, a valve associated with said outlet and adapted to selectively open or close said outlet, and valve control means operable from outside of the catchbasin to selectively open or close said valve, wherein said receptacle comprises at least two parts, detachably in interconnected in a manner to provide a sealed container when said valve is closed, at least one of said parts being removable from said catchbasin cavity.

2. The structure according to claim 1 further comprising sensing means for detecting the presence of a predetermined contaminant in said receptacle, and for generating a signal indicative of said presence.

3. The structure according to claim 2, further comprising control means operative to close said valve in response to a signal from said sensing means thereby substantially preventing said contaminant from entering said catchbasin cavity and said sewer system.

4. The structure according to claim 1 wherein said at least one removable part of the receptacle comprises the outlet.

5. The structure according to claim 1 wherein said receptacle has in its lowermost portion two outlets, each associated with a valve adapted to open or close the respective outlet, wherein a first of the outlets is connected to a liquid retention system and the second outlet is in communication with the cavity and the sewer system.

6. The structure according to claim 5 further comprising sensing means for detecting the presence of a predetermined contaminant in said receptacle, and control means operative to open the valve associated with the first outlet and to close the valve associated with the second outlet in response to a signal from said sensing means, thereby preventing said contaminant from entering said cavity and enabling its flow to said liquid retention system.

7. The structure according to claim 1 wherein said at least one removable part of said receptacle comprises at least one of the outlets.

* * * * *